US006278046B1

(12) United States Patent
Sikra et al.

(10) Patent No.: US 6,278,046 B1
(45) **Date of Patent: *Aug. 21, 2001**

(54) PERCUSSION INSTRUMENT ACTUATOR ASSEMBLY WITH SELECTABLE ACTUATION

(75) Inventors: Richard A. Sikra, Palmdale; Donald G. Lombardi, Thousand Oaks, both of CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/597,671

(22) Filed: Jun. 20, 2000

Related U.S. Application Data

(63) Continuation-in-part of application No. 09/493,294, filed on Jan. 28, 2000.

(51) Int. Cl.[7] ..... G10D 13/02

(52) U.S. Cl. ..... 84/422.1; 84/422.2; 84/422.3

(58) Field of Search ..... 84/422.1, 422.2, 84/422.3

(56) References Cited

U.S. PATENT DOCUMENTS

| | | | | |
|---|---|---|---|---|
| 2,845,830 | | 8/1958 | Haviland | 84/422.1 |
| 3,747,464 | | 7/1973 | Russell | 84/422.1 |
| 4,324,164 | * | 4/1982 | Monte et al. | 84/744 |
| 5,789,688 | * | 8/1998 | Schiano | 84/422.1 |
| 5,990,401 | | 11/1999 | Braun et al. | 84/422.1 |

* cited by examiner

*Primary Examiner*—Bentsu Ro
*Assistant Examiner*—Shih-yung Hsieh
(74) *Attorney, Agent, or Firm*—William W. Haefliger

(57) ABSTRACT

Percussion instrument drive apparatus, comprising in combination first and second drives associated with first and second percussion instruments, respectively, and a foot actuated pedal and a pedal driven driver selectively movable to drive one or the other of the first and second drives, as the pedal is actuated, the driver being carried independently of the pedal.

35 Claims, 7 Drawing Sheets

23
23a
20c
20
20b
25
27
28
76
26
4
7
20a
14
16
14a
15
130
17'
3
21'
21
14b
14a
7
21a
29
29a
17
84
76a
77
13a
18
19
13
12
18a
121
120
19a
10
11
4

13
230
116
120
18
124
126
13a
11
21'
14a'
234
135
230
232
116
78
15
79
80
76
77
26a
17
18
77
120
124
126

PERCUSSION INSTRUMENT ACTUATOR ASSEMBLY WITH SELECTABLE ACTUATION

This application is a continuation-in-part of prior U.S. patent application Ser. No. 09/493,294 filed Jan. 28, 2000.

BACKGROUND OF THE INVENTION

This invention relates generally to accurately and controlled selective actuation of different percussion instruments; and more particularly concerns improvements in drive apparatus to realize these objectives.

There is frequent need for drummer's foot operation of different percussion instruments, as by means of pedal operation. What is needed is a simple, effective and reliable drive system that is pedal operated, and which enables single foot driven accurate operation of multiple pedals, forcefully to selectively actuate different instruments such as drums, cymbals, and cowbells, and other percussion instruments. No prior system of which we are aware incorporates the multiple advantages in construction, operation and results which are now provided by the present invention.

SUMMARY OF THE INVENTION

It is a major object of the invention to provide an improved percussion instrument actuating assembly meeting the above needs. Basically, the assembly comprises, in combination a) carrier structure, b) first and second pedals carried to extend in generally side-by-side relation and to independently pivot, c) first rotary axle structure operatively connected to the first pedal to be rotated thereby, and having rotary motion output locations spaced apart along the axle structure and via which rotary motion is transmissible to actuate different percussion instruments in response to selected coupling of the first pedal to one or the other of such output locations, and pivoting of the first pedal, and d) a second axle structure operatively connected to the second pedal to transmit motion for actuating an additional percussion instrument, in response to selected pivoting of the second pedal.

Accordingly, the user can quickly select which of different percussion instruments is to be actuated. Also, pivot integrity of each pedal, about a single axis, is maintained.

It is another object to provide first rotary axle structure that extends generally horizontally above the levels of the two pedals, and second axle structure that extends generally vertically to project above the level of the first rotary axle structure. In this regard, a guide tubing carried by the carrier may be provided, and within which the second axle structure extends, and including cymbals elements carried by the tubing and the second axle structure to clash in response to pivoting of the second pedal. Two support legs for the assembly may be carried by the tubing, and in such manner that a base plate typically supports the two pedals to independently pivot, the base plate also being separately pivotally connected to a tubing support frame so that the base plate can be folded upwardly with the pedals, for assembly storage and transport.

A further object is to provide for connection or connecting of a mallet, or mallets, to the first rotary axle structure at an intermediate and/or end location or locations on that axle structure. A percussion instrument support may be provided on the frame, and located in offset relation to the upright tubing and to the first axle structure, whereby a percussion instrument such as a cowbell may be carried and presented for impact by one such mallet.

Yet another object is to provide primary and secondary sections of the first axle structure, to be supported for independent rotation, a first mallet being connected to, or connectible to, one of said sections, the other of the sections being rotatable to transmit motion to actuate a different percussion instrument, via another of the rotary motion output locations.

In this regard, an auxiliary carrier may be provided as at a remote location, together with an auxiliary axle carried by the auxiliary carrier, to be rotated by said other section of the first rotary axle structure, the second mallet carried by the auxiliary axle, for rotation.

An additional object is to provide a clutch that is shiftable to transmit rotary motion to one or the other of said sections, in response to pivoting of the first pedal. A drive chain may be operatively coupled between one of the two pedals and a peripheral portion of the clutch.

An important further object is to provide percussion instrument drive apparatus, that comprises:

a) first and second drives associated with first and second percussion instruments, respectively, b) a foot actuated pedal and a pedal driven driver selectively movable to drive one or the other of the first and second drives, as the pedal is actuated, c) the driver being carried independently of the pedal.

As will be seen, the driver may be provided to be movable with the selected first or second drive that is driven by the driver. Additionally, the first and second drives, together with the driver, are typically and advantageously rotatable about a common axis, for simplicity and ruggedness, as is important in drum pedal apparatus repeatedly receiving high impact foot loading by the drummer. The drives and driver may be spaced upwardly of the pedal and coupled to it as by a chain and sprocket.

An added object is to provide for coupling of the driver to the first drive in response to displacement of the driver in a primary direction, and alternative coupling of the driver to the second drive, in response to displacement of the driver in a secondary direction. Such primary and secondary direction are typically substantially transverse in relation to the longitudinal direction of extent of the pedal.

Another object is to provide the first and second drives and driver to be independently rotatable about a common axis which extends generally transversely relative to the longitudinal direction of extent of the pedal.

These and other objects and advantages of the invention, as well as the details of an illustrative embodiment, will be more fully understood from the following specification and drawings, in which:

DRAWING DESCRIPTION

DETAILED DESCRIPTION

Figure 1:
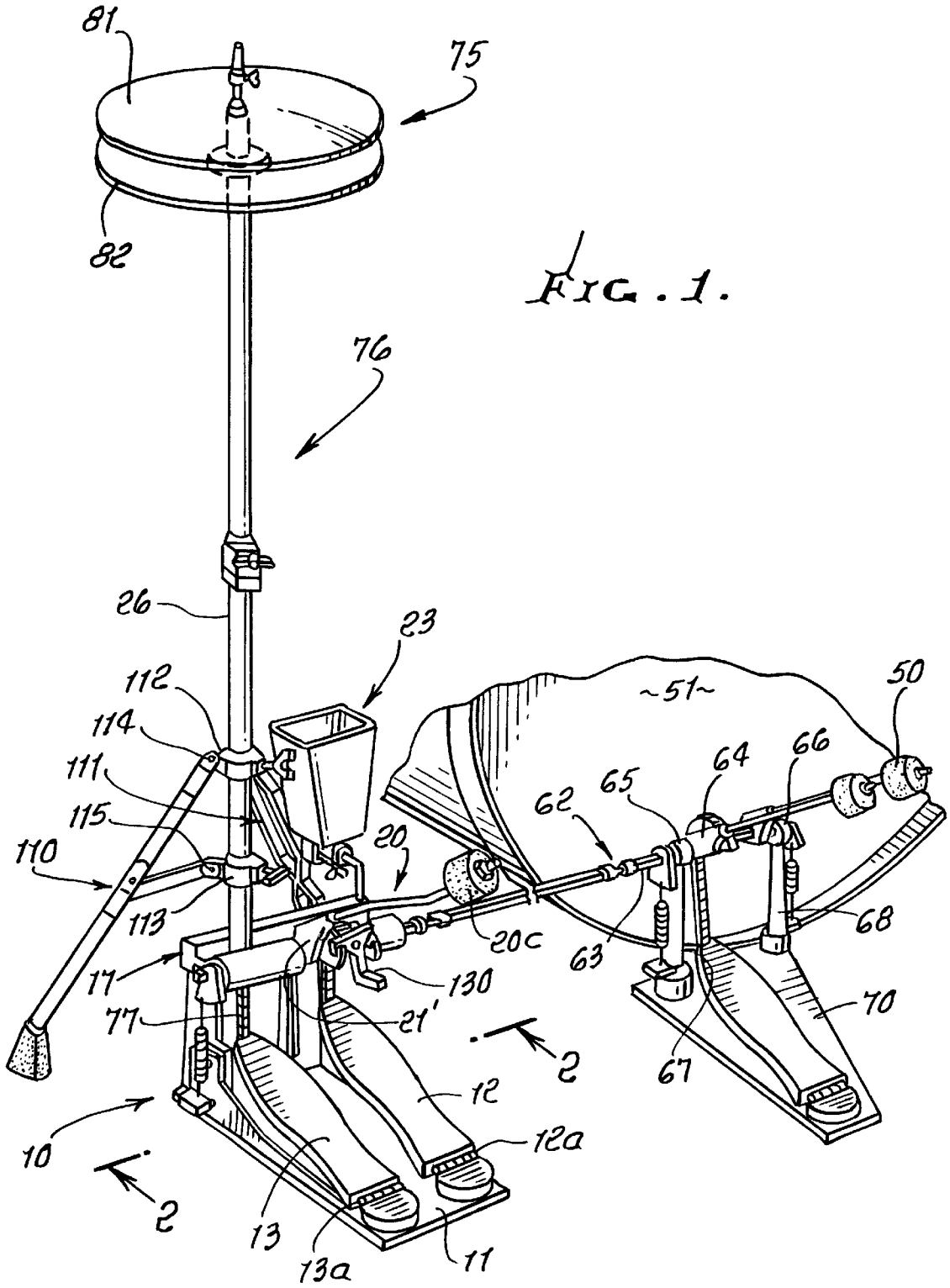
FIG. 1 is a perspective view of one form of the actuator assembly, which is preferred.
Figure 2:
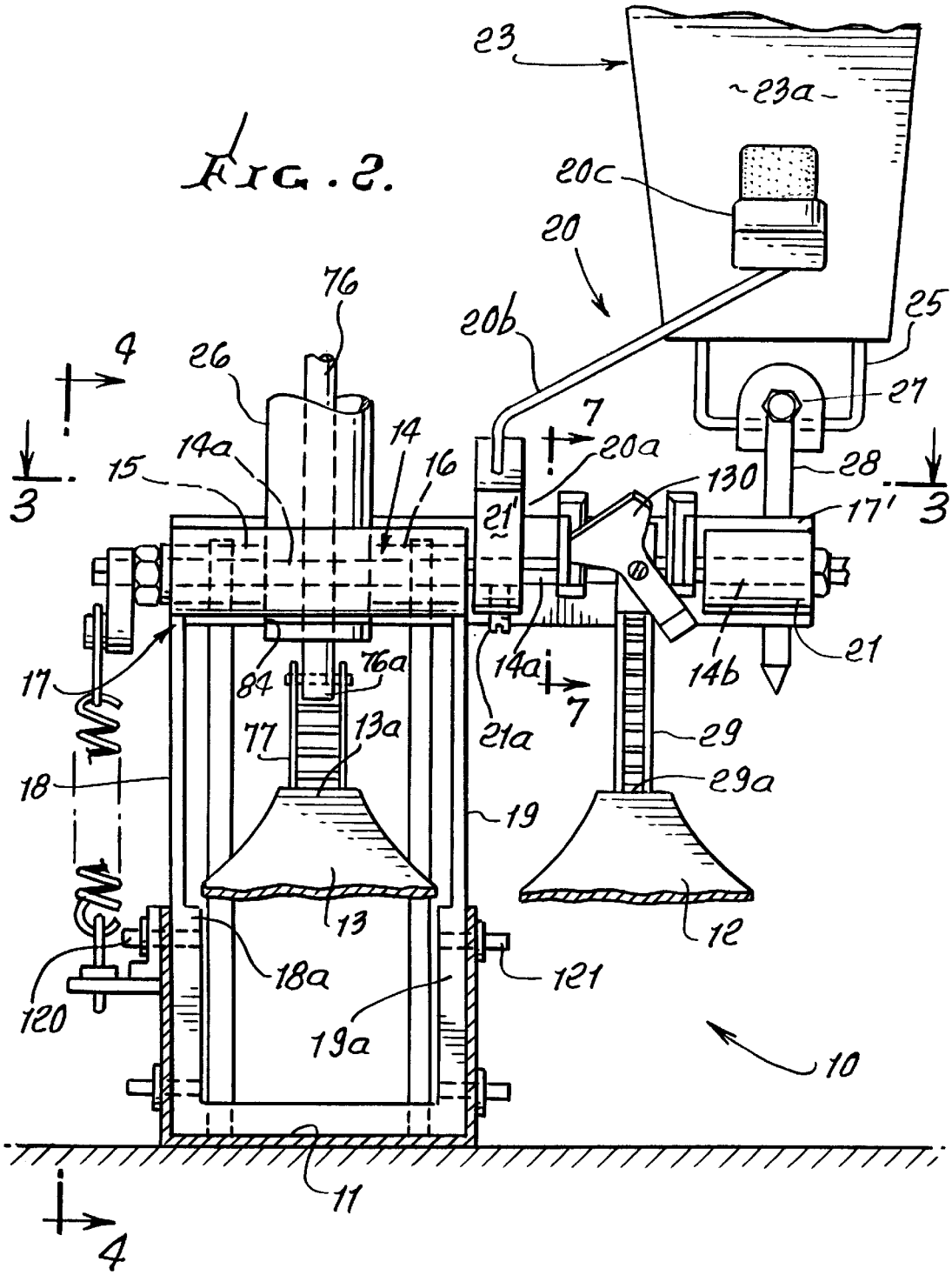
FIG. 2 is an enlarged frontal elevation, taken on lines 2—2 of FIG. 1.

In FIGS. 1 and 2, a carrier structure 10 is shown to include a generally horizontal base plate 11 on which first and second pedals 12 and 13 are carried to extend forwardly and upwardly in side-by-side relation. The pedals have pivoted support at their rearward ends, as indicated at 12*a* and 13*a*. Such support is preferably provided by a roller bearing or bearings, as for example is disclosed in my U.S. Pat. No. 5,627,332, incorporated herein by reference. The two pedals pivot independently, whereby the drummer's foot or shoe can operate either pedal, independently.

In accordance with the invention, first rotary axle structure is operatively connected to the first pedal to be rotated thereby, and having rotary motion output locations spaced apart along the axle structure and via which rotary motion is transmissible to actuate different percussion instruments in response to selected pivoting of the first pedal; and in addition, a second axle structure in operatively connected to the second pedal to transmit motion for actuating an additional percussion instrument, in response to selected pivoting of the second pedal.

Figure 3:
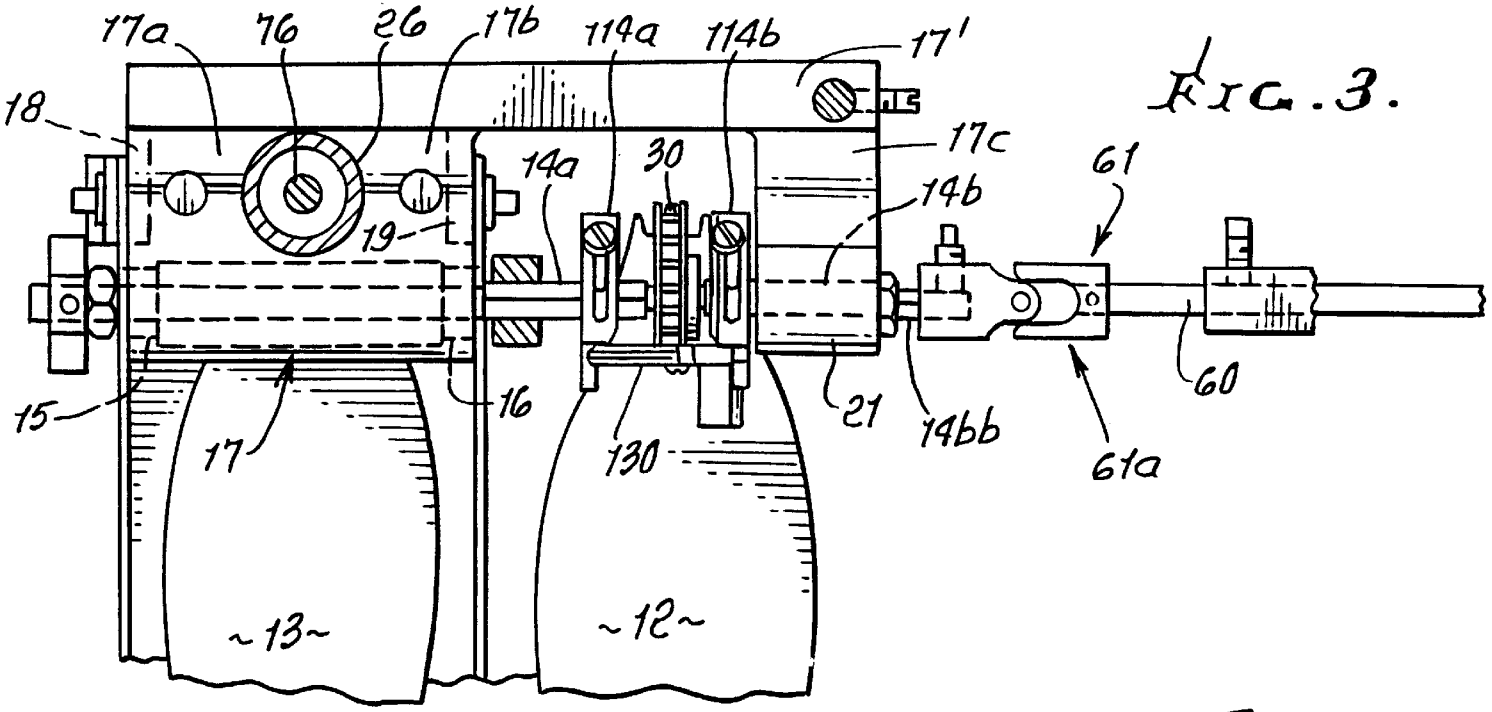
FIG. 3, is a plan view, taken in section on lines 3—3 of FIG. 2, and showing clutch drive of a first shaft.

In the example, as shown as in FIGS. 1, 2, and 3, first or primary axle structure is indicated generally at 14, and includes a first section 14*a* supported at horizontally spaced bearings 15 and 16. The latter are carried by a frame 17 supported by upright pedestals 18 and 19 respectively carried by the base plate. A second section 14*b* of the first axle structure extends endwise of and coaxially with 14*a*. A bearing 21, spaced from bearings 15 and 16, supports section 14*b* of the axle structure 14 for rotation, independently of 14*a*. Bearing 21 is carried by a horizontal extension 17' of frame 17. Frame lug sections 17*a*, 17*b* and 17*c* carry the bearings 15, 16, and 21, those lug sections being longitudinally spaced apart, in the axial direction of the axle structure 14, and attached to longitudinally extending frame member 17'.

A mallet or drum beater 20 is operatively connected to the first axle structure as at a motion output location 20*a*. The beater may include an arm 20*b* to which a beater head 20*c* is attached. The opposite end of the arm is shown as connected to a rotor 21' attached at 21*a* to the axle section 14*a*. See FIG. 2. Arm 20*b* extends diagonally away from a vertical tube 26, so as to position the beater head 20*c* to strike a percussion instrument 23 in response to rotation of the shaft section 20*a*, effected by down pivoting of the first pedal 12.

Figure 7:
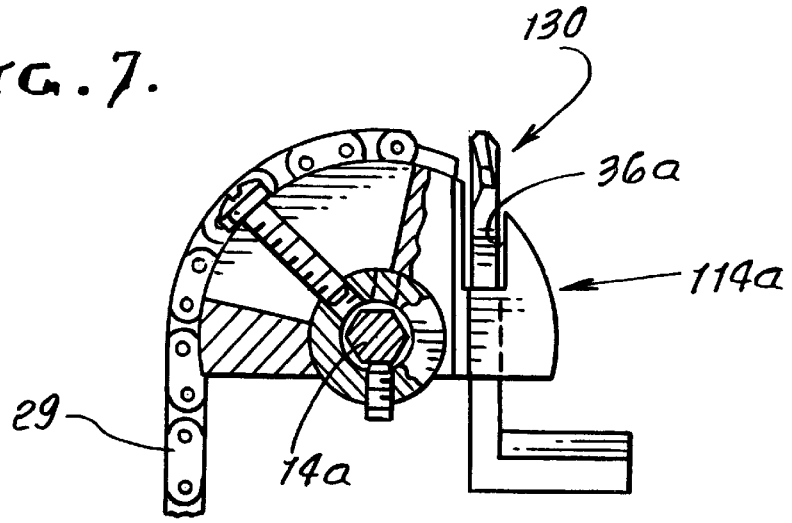
FIG. 7 is a section taken on lines 7—7 of FIG. 2.
Figure 8:
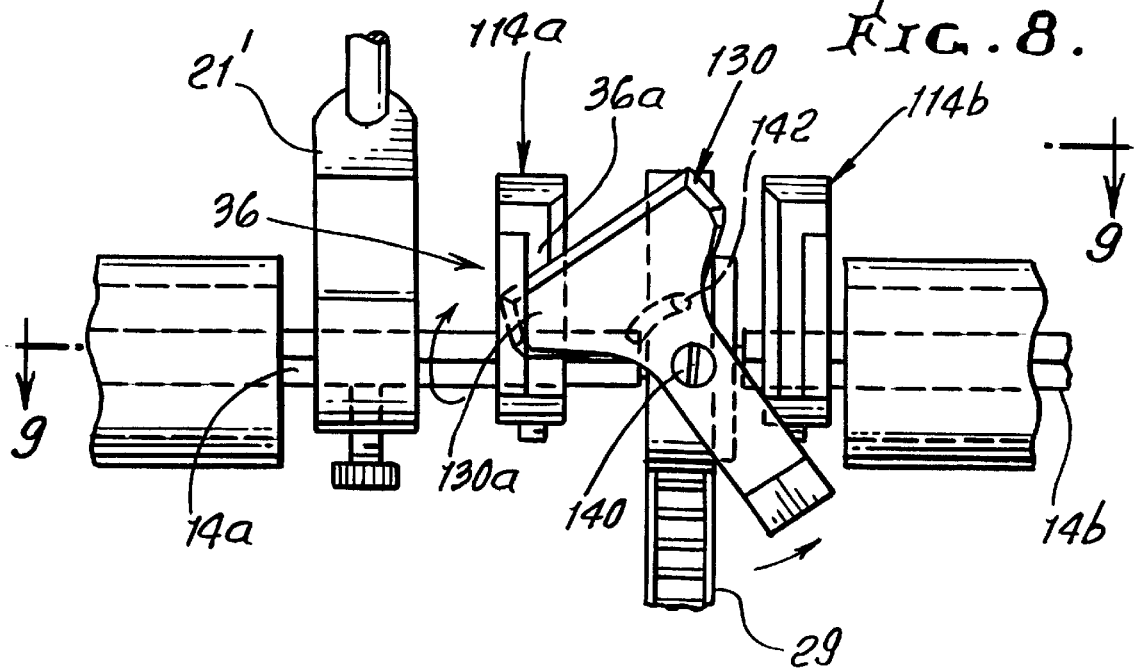
FIG. 8 is an enlarged elevation to illustrate one clutching and drive mode.
Figure 9:
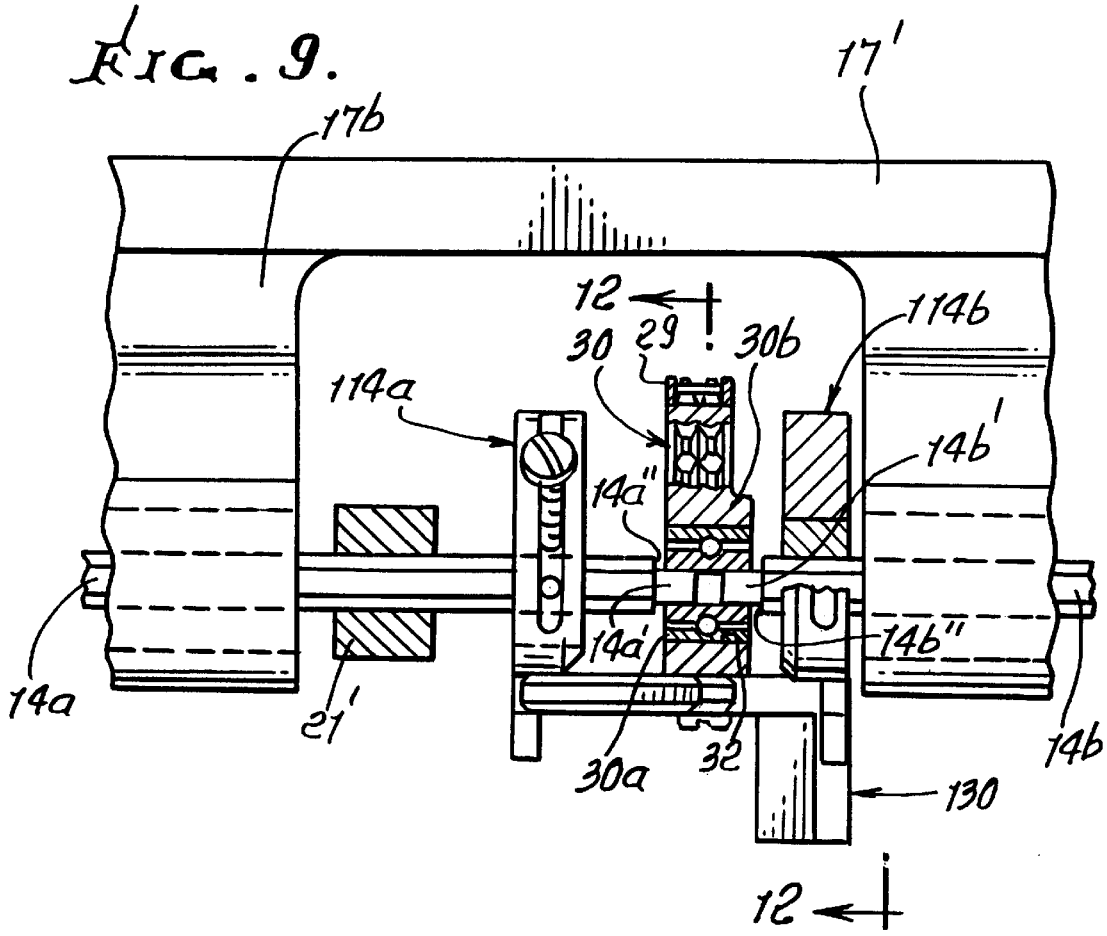
FIG. 9 is an enlarged fragmentary section taken on lines 9—9 of FIG. 8.

Instrument 23 may for example comprise a cow bell shell indicated at 23*a*, carried by the frame 17, to open upwardly, offset from vertical tubing 26. FIGS. 1 and 2 show a support 25 under the shell 23*a* lower end, and removably attached at 27 to a strut 28 supported by and projecting upwardly from the frame 17. A drive chain 29 is connected at one end 29*a* to the forward end of pedal 12, and at the chain upper end to a driver rotor in the form of a sprocket 30. See also FIGS. 7 and 8. That sprocket is shown in FIG. 9 as rotatable about coaxial guide extensions 14*a*' and 14*b*' of the axle sections 14*a* and 14*b* to rotate as the pedal 12 moves downwardly. See also sprocket bearing 30*a* retained in position between axle end shoulders 14*a*" and 14*b*".

Figure 10:
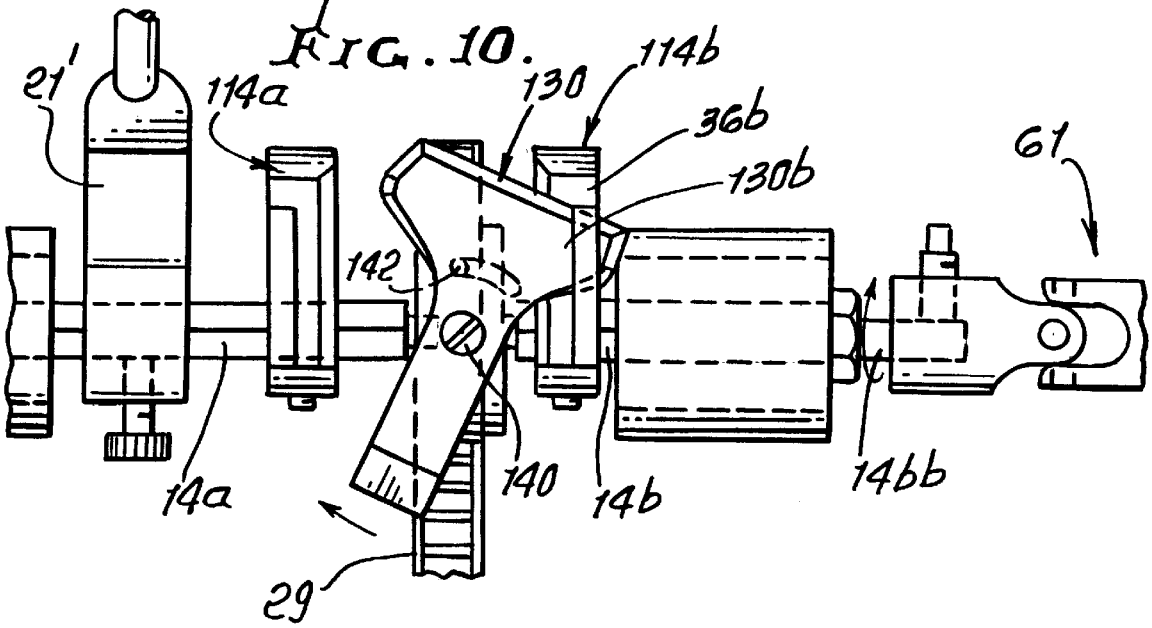
FIG. 10 is a view like FIG. 8, but showing another clutching and drive mode.
Figure 11:
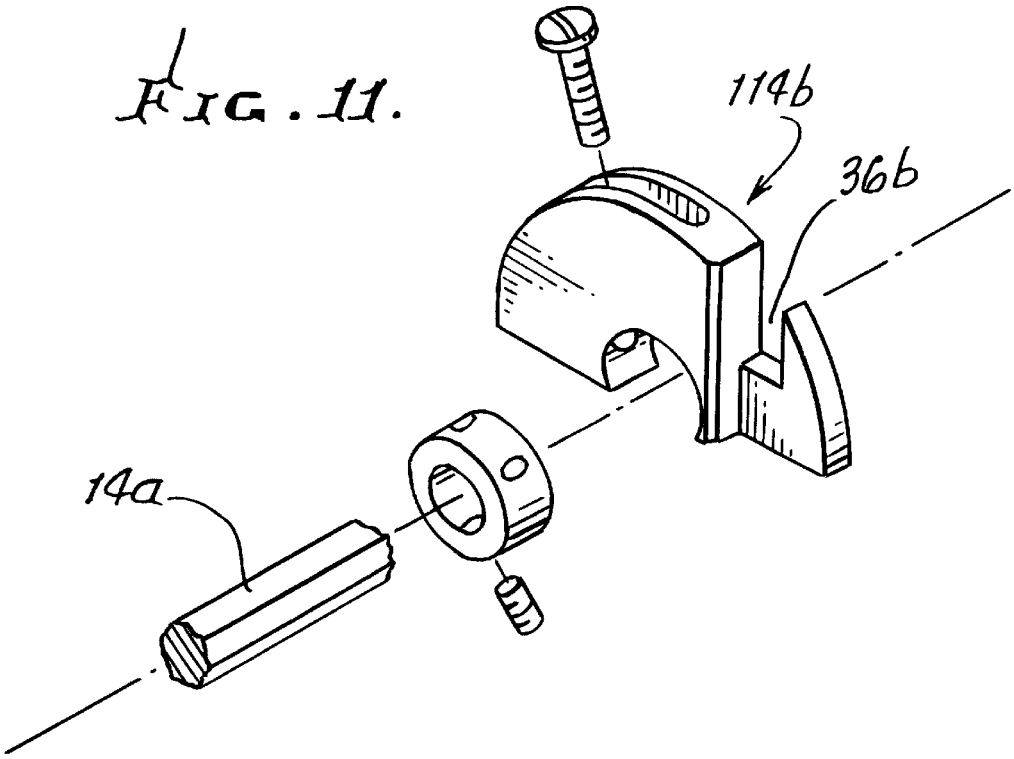
FIG. 11 is an exploded perspective view showing details of a driver.
Figure 13:
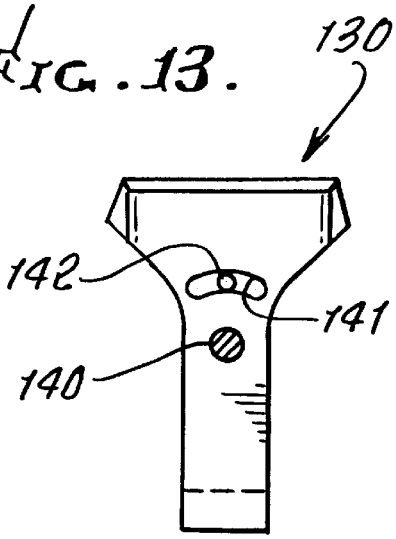
FIG. 13 is an elevation taken on lines 13—13 of FIG. 12.
Figure 12:
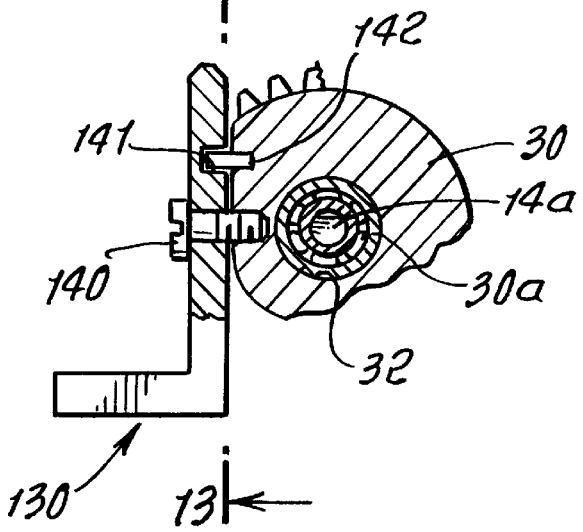
FIG. 12 is a section taken on lines 12—12 of FIG. 9.

In accordance with an important aspect of the invention, a coupler is carried by the driver 30 and is shiftable to transmit rotary motion to one or the other of axle sections 14*a* and 14*b*, via drive rotors 114*a* and 114*b* coupled to the axle sections, in response to downward pivoting of the pedal 12. Rotor or sprocket 30 provides such a preferred coupler, as by means of an axially extending through opening 32 (see FIG. 9) through the rotor hub 30*b*, and operable to receive the axle and extensions 14*a*' and 14*b*', as referred to above. FIGS. 2 and 8 show the coupler 130 in leftward shifted position, with its wing 130*a* coupled at 36 to drive rotor 114*a* as via reception in a slot 36*a* in that rotor. See also FIG. 11. FIG. 10 shows the coupler 130 shifted to the right, to de-couple from 114*a*, and to couple to 114*b*, as via reception of wing 130*b* in a slot 36*b* in 114*b*. A fastener 140 retains 130 to driver 30 as seen in FIGS. 8, 10, 12 and 13. A pin 142 on 30 is received in a groove 141 in 130 to limit angular shifting. Therefore, operation of pedal 12 serves to rotate axle section 14*a*, and mallet 20, or to rotate axle section 14*b*, and operate remote mallet 50, that strikes a remote percussion instrument such as a drum 51, to be described, and as seen in FIG. 1. A dog 330 projects from the coupler 330 to be engaged by the drummer's show, to shift the coupler, as described.

The second or secondary section 14*b* of the axle structure in effect provides a second rotary motion output location, as for example at the protruding end 14*bb* of the section 14*b*. See FIG. 3. The second mallet 50 is operatively connected to axle section end 14*bb*, as via an elongated extension or intermediate shaft 60 that can be coupled at 61 to end 14*bb*, as shown. A universal joint connection is shown at 61*a*. The opposite end of shaft 60 is coupled at universal joint 62 to rotary axle 63 to which mallet 50 is connected, at 64. Axle 63 is supported for rotation at bearings 65 and 66 carried by upright pedestals 67 and 68, the lower ends of which are supported by an adjustable position auxiliary base plate 70, as shown. Accordingly, pedal 12 may be operated to cause selective beating of drum 51, or beating of the cow bell 23.

Referring to FIGS. 1, 2 and 8, second pedal 13 is operatively connected to a second axle structure, to actuate an additional percussion instrument, such as cymbals 75. The illustrated second axle structure 76 is shown as extending vertically in sidewardly offset relation to above first section 14*a* of the first axle structure. A chain 77 is connected between the forward end 13*a* of pedal 13, and the lower end 76*a* of vertical axle or rod 76, to lower the latter as the pedal is pushed downwardly. A compression spring may be employed to urge the axle 76 upwardly, as after its downward displacement. See in FIG. 4 the spring 78 positioned beneath a flange 79 on the axle, and guided vertically by the bore 80 of protective tubing 26; the tubing protecting the axle as it moves up and down to displace cymbals upper disc 81 up and down. Tubing 26 also supports the cymbals lower disc 82, to be struck or clashed by the upper disc. The lower end 26*a* of the tubing is supported at 84 by the frame 17, between lugs 17*a* and 17*b*, as shown in FIGS. 2 and 3.

Figure 6:
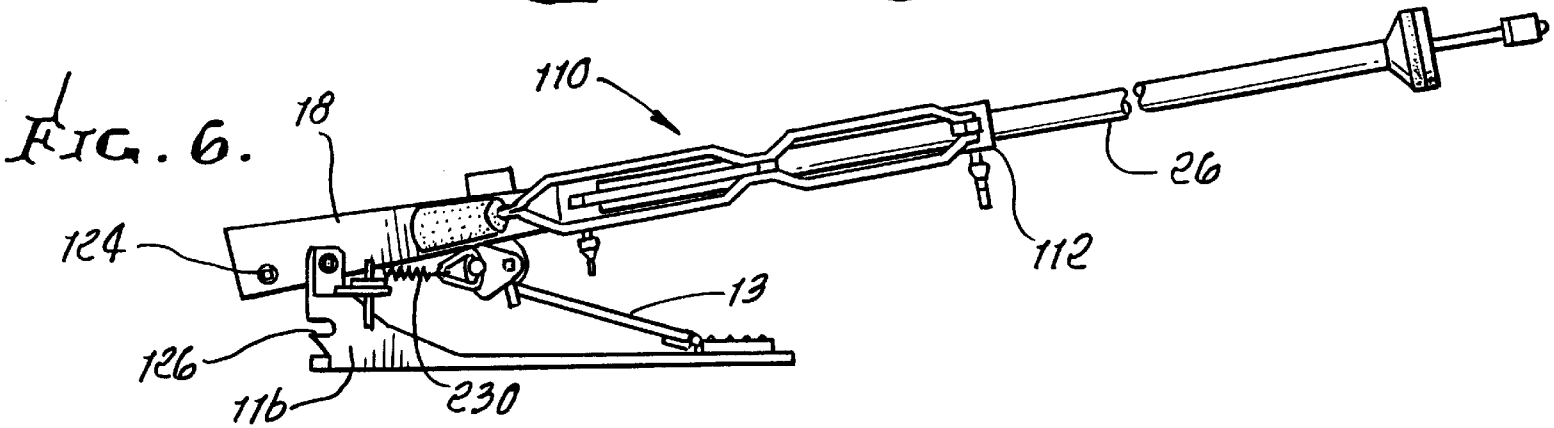
FIG. 6 is a view showing further details of the pivoted or folded mode.
Figures 4, 5:
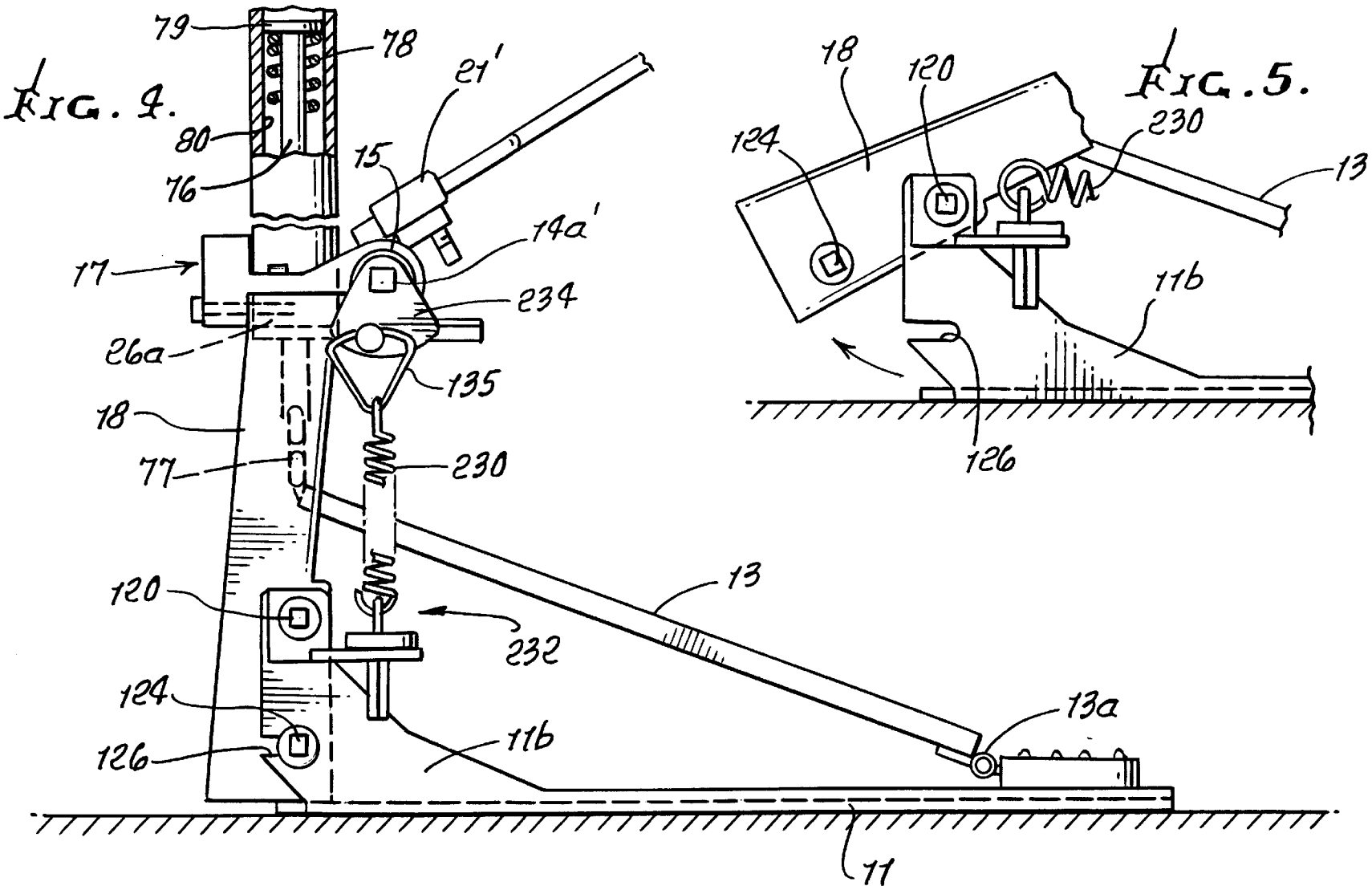
FIG. 4 is a side elevation taken on lines 4—4 of FIG. 2.
FIG. 5 is a fragmentary side elevation showing a pivoting mode of the apparatus, as for storage.

A further feature is the provision of two support legs 110 and 111 pivotally carried by tubing 26. Note collars 112 and 113 extending about and coupled to the tubing, and pivotally connected at 114 and 115 to the support legs. This allows extension of the legs for vertically stabilized support of the apparatus as in FIG. 1 position, or collapse of the legs for transport, as shown in FIG. 6, with the legs extending alongside the tubing 26. This is further facilitated by pivotal connection at 120 and 121 of the base plate 11 to the lower end portions 18*a* and 19*a* of the pedestals 18 and 19, as shown in FIGS. 2, 4 and 5. When the pedestals or tubing 76 extend upright, a projection 124 or projections, on the pedestal 18 lower end portion is received in guide slot 126 defined by the base plate upright section 11*b*.

Finally, a tension spring 230 is provided to rotatably urge the first axle section 14*a* in restoring rotary direction, tending to elevate the forward end of the pedal 12. The lower end of the spring is connected as at 232 to the lower portion of upright 18; and the spring upper end is connected as via a loop 135 (see FIG. 4) to an over-center or eccentric lever 234 coupled to the end 14*a'* of axle section 14*a*, proximate upright 18, as best seen in FIGS. 4 and 10, tending to restore the beaters to retracted positions. Apparatus as seen in FIGS. 1–9 is preferred.

We claim:

1. Percussion instrument drive apparatus, comprising in combination:

a) first and second drives associated with first and second percussion instruments, respectively, b) a foot actuated pedal and a pedal driven driver selectively movable to drive one or the other of the first and second drives, as the pedal is actuated, c) said driver being carried independently of the pedal.

2. The combination of claim 1 wherein said driver is movable with the selected first or second drive that is driven by the driver.

3. The combination of claim 2 wherein said first and second drives, and the driver are rotatable about a common axis.

4. The combination of claim 2 wherein the driver couples to the first drive in response to displacement of a coupler on the driver in a primary direction, and alternative coupling of the driver to the second drive, in response to displacement of the coupler in a secondary direction.

5. The combination of claim 4 wherein the pedal extends generally longitudinally, and said primary and secondary directions are substantially transverse in relation to the longitudinal direction of extent of the pedal.

6. The combination of claim 5 wherein the first and second drives and driver are spaced upwardly relative to the pedal.

7. The combination of claim 6 wherein the first and second drives and the driver are carried to be independently rotatable about a common axis which extends generally transversely relative to the longitudinal direction of extent of the pedal.

8. The combination of claim 1 including said percussion instruments coupled to said drives.

9. The combination of claim 8 wherein the first percussion instruments includes a first beater and the second percussion instrument includes a second beater.

10. The combination of claim 9 wherein the first percussion instrument includes a cowbell, and the second percussion instrument includes a drum.

11. The combination of claim 1 including a collapsible stand carrying said drives and driver, and also carrying said pedal.

12. The combination of claim 1 wherein said first and second drives have slots and the drives include a coupler selectively shiftable into one or the other of said slots.

13. The combination of claim 12 including a dog on the coupler to be engaged by the drummer's shoe to shift the coupler, as aforesaid.

14. In a percussion instrument actuating assembly, the combination comprising a) carrier structure, b) first and second pedals carried to extend in generally side-by-side relation and to independently pivot, c) first and second drives including first rotary axle structure operatively connected to the first pedal to be rotated thereby, and having rotary motion output locations spaced apart along the axle structure and via which rotary motion is transmissible to actuate different percussion instruments in response to selected coupling of the first pedal to one or the other of said output locations, and a first pedal driven driver selectively movable to drive one or the other of said drives as the first pedal is actuated, said drives carried independently of the first pedal, and d) a second axle structure operatively connected to the second pedal to transmit motion for actuating an additional percussion instrument, in response to selected pivoting of the second pedal.

15. The combination of claim 14 wherein said first rotary axle structure extends generally horizontally above the levels of the two pedals, and said second axle structure extends generally vertically to project above the level of the first rotary axle structure.

16. The combination of claim 15 including a tubing carried by the carrier and within which the second axle structure extends, and including cymbals elements carried by the tubing and the second axle structure to clash in response to pivoting of the second pedal.

17. The combination of claim 16 including at least two support legs pivotally carried by the tubing.

18. The combination of claim 17 wherein the carrier includes a base plate on which the two pedals are mounted to independently pivot.

19. The combination of claim 18 in which the carrier includes a frame that carries said tubing, the base plate pivotally connected to the frame to be folded upwardly along with the pedals, for assembly storage.

20. The combination of claim 16 wherein the carrier includes frame structure that supports the tubing and that also supports said first rotary axle structure.

21. The combination of claim 14 including a chain operatively connected between the second pedal and the second axle structure.

22. The combination of claim 14 including a mallet operatively connected to the first rotary axle structure via one of said motion output locations.

23. In a percussion instrument actuating assembly, the combination comprising a) carrier structure, b) first and second pedals carried to extend in generally side-by-side relation and to independently pivot, c) first and second drives including first rotary axle structure operatively connected to the first pedal to be rotated thereby, and having rotary motion output locations spaced apart along the axle structure and via which rotary motion is transmissible to actuate different percussion instruments in response to selected coupling of the first pedal to one or the other of said output locations, and a first pedal driven driver selectively movable to drive one or the other of said drives as the first pedal is actuated, said drives carried independently of the first pedal, and d) a second axle structure operatively connected to the second pedal to transmit motion for actuating an additional percussion instrument, in response to selected pivoting of the second pedal, e) and including a mallet operatively connected to the first rotary axle structure via a motion output location located at an end of said first rotary axle structure.

24. In a percussion instrument actuating assembly, the combination comprising a) carrier structure, b) first and second pedals carried to extend in generally side-by-side relation and to independently pivot, c) first and second drives including first rotary axle structure operatively connected to the first pedal to be rotated thereby, and having rotary motion output locations spaced apart along the axle structure and via which rotary motion is transmissible to actuate different percussion instruments in response to selected coupling of the first pedal to one or the other of said output locations, and a first pedal driven driver selectively movable to drive one or the other of said drives as the first pedal is actuated, said drives carried independently of the first pedal, and d) a second axle structure operatively connected to the second pedal to transmit motion for actuating an additional percussion instrument, in response to selected pivoting of the second pedal, e) and including a first mallet operatively to the first rotary axle structure at one of said motion output locations, and a second mallet operatively connected to the first rotary axle structure at a motion output location located at an end of said first rotary axle structure.

25. In a percussion instrument actuating assembly, the combination comprising a) carrier structure, b) first and second pedals carried to extend in generally side-by-side relation and to independently pivot, c) first and second drives including first rotary axle structure operatively connected to the first pedal to be rotated thereby, and having rotary motion output locations spaced apart along the axle structure and via which rotary motion is transmissible to actuate different percussion instruments in response to selected coupling of the first pedal to one or the other of said output locations, and a first pedal driven driver selectively movable to drive one or the other of said drives as the first pedal is actuated, said drives carried independently of the first pedal, and d) a second axle structure operatively connected to the second pedal to transmit motion for actuating an additional percussion instrument, in response to selected pivoting of the second pedal, e) said first axle structure extending generally horizontally above the levels of the two pedals, and said second axle structure extends generally vertically to project above the level of the first rotary axle structure, f) there being tubing carried by the carrier and within which the second axle structure extends, and including cymbals elements carried by the tubing and the second axle structure to clash in response to pivoting of the second pedal, g) the carrier including frame structure that supports the tubing and that also supports said first rotary axle structure, h) and including a percussion instrument support on said frame structure, and located in offset relation to said tubing and to said first rotary axle structure.

26. The combination of claim 25 including a percussion instrument supported by said support.

27. The combination of claim 26 including a mallet operatively connected to the first rotary axle structure at one of said motion output locations, said mallet located to strike said percussion instrument in response to rotation of the first rotary axle structure effected by pivoting of the first pedal causing motion transmission to the mallet via one of said locations.

28. The combination of claim 27 wherein the first rotary axle structure includes primary and secondary sections that are supported for independent rotation, the first mallet connected to one of said sections, the other of said sections being rotatable to transmit motion to actuate a different percussion instrument, via another of said rotary motion output locations.

29. The combination of claim 28 including a second mallet operatively connected to said other section.

30. The combination of claim 29 including an auxiliary carrier, and an auxiliary axle carried by the auxiliary carrier to be rotated by said other section of the first rotary axle structure, the second mallet carried by the auxiliary axle, for rotation.

31. The combination of claim 29 including a driver that is movable to transmit rotary motion to one or the other of said sections, in response to pivoting of the first pedal.

32. In a percussion instrument actuating assembly, the combination comprising a) carrier structure, b) first and second pedals carried to extend in generally side-by-side relation and to independently pivot, c) first and second drives including first rotary axle structure operatively connected to the first pedal to be rotated thereby, and having rotary motion output locations spaced apart along the axle structure and via which rotary motion is transmissible to actuate different percussion instruments in response to selected coupling of the first pedal to one or the other of said output locations, and a first pedal driven driver selectively movable to drive one or the other of said drives as the first pedal is actuated, said drives carried independently of the first pedal, and d) a second axle structure operatively connected to the second pedal to transmit motion for actuating an additional percussion instrument, in response to selected pivoting of the second pedal, e) said first axle structure extending generally horizontally above the levels of the two pedals, and said second axle structure extends generally vertically to project above the level of the first rotary axle structure, f) there being tubing carried by the carrier and within which the second axle structure extends, and including cymbals elements carried by the tubing and the second axle structure to clash in response to pivoting of the second pedal, g) the carrier including frame structure that supports the tubing and that also supports said first rotary axle structure, h) and wherein said driver comprises a rotor having a coupler movable to couple to one or the other of said sections, as selected, and the rotor having a peripheral portion coupled to said one pedal, to be rotated thereby.

33. The combination of claim 32 including a drive chain operatively coupled between said one pedal and said peripheral portion of the rotor.

34. The combination of claim 32 including drive rotors on said sections, and having slots into which the coupler is alternatively shiftable.

35. The combination of claim 34 wherein the coupler has pivoted connection to the driver rotor to be pivotable into one or the other of said slots.

* * * * *